US005129529A

United States Patent [19]

Manyek

[11] Patent Number: 5,129,529

[45] Date of Patent: Jul. 14, 1992

[54] UNCOUPLER LEVER WITH A WEDGE LOCK

[75] Inventor: Leonard F. Manyek, Lansing, Ill.

[73] Assignee: Triax Tube Co., Benton Harbor, Mich.

[21] Appl. No.: 774,645

[22] Filed: Oct. 14, 1991

Related U.S. Application Data

[63] Continuation of Ser. No. 486,858, Mar. 1, 1990, abandoned.

[51] Int. Cl.[5] ..... B61G 7/02

[52] U.S. Cl. ..... 213/166; 213/159; 213/162; 213/211; 213/219; 81/177.2; 403/109; 403/374

[58] Field of Search ..... 213/159, 160, 161, 162, 213/163, 164, 165, 166, 171, 211, 214, 216, 218, 219; 81/177.2, 488; 403/109, 374, 379; 16/115, DIG. 41

[56] References Cited

U.S. PATENT DOCUMENTS

| | | | |
|---|---|---|---|
| 239,834 | 4/1881 | Paldi | 403/374 X |
| 2,107,835 | 2/1938 | Pierce | 403/374 X |
| 3,409,146 | 11/1968 | Taylor | 213/166 |
| 3,424,039 | 1/1969 | Scott | 81/177.2 |
| 4,030,613 | 6/1977 | Chierici | 213/166 |
| 4,378,890 | 4/1983 | Empson | 213/166 |
| 4,460,099 | 7/1984 | Empson | 213/159 |
| 4,528,865 | 7/1985 | Nagano | 403/374 X |
| 4,899,050 | 2/1990 | Cianflone | 81/488 X |

*Primary Examiner*—Robert J. Oberleitner
*Assistant Examiner*—S. Joseph Morano
*Attorney, Agent, or Firm*—James D. Hall

[57] ABSTRACT

An adjustable uncoupling lever with a shiftable wedge lock. The lever includes two longitudinally shiftable rods having parts spaced from one another. The wedge lock is driven between the two rod parts to secure the rods together.

5 Claims, 1 Drawing Sheet

UNCOUPLER LEVER WITH A WEDGE LOCK

This is a continuation-in-part of copending application(s) Ser. No. 0/486/858 filed on Mar. 1, 1990 now abandoned.

BACKGROUND OF THE INVENTION

This invention relates to the railroad industry and has specific relevance to a two piece adjustable uncoupling lever having a unique interlock.

In the railroad industry, uncoupling levers are shiftably connected between a car's lock lifter and bracket carried by the frame. The uncoupling levers typically include a lower depending extension extending downwardly from the bracket. To uncouple to railroad cars, a railroad man walks along side of the railroad cars and strikes the lower extension to cause the rod to activate the car's lock lifter and release the cars. Such uncoupling levers have been formed from two rods slidably engaged to be adjustable relative to one another to accommodate the varying distance between the car's lock lifter and rod bracket. After being adjusted, the two rods must be secured against shifting relative to one another. An example of such two piece rods may be had by reference to U.S. Pat. No. 4,030,613. Heretofore, the two adjustable rods were fixed to one another by either welding after adjustment or by friction of the telescopically connected rods. Each method of retaining the rods in a fixed relationship have problems associated with them. For instance it is inconvenient to have a welder in the middle of a railroad yard to spot weld the uncoupler rods together. The friction method is not always reliable.

SUMMARY OF THE INVENTION

This invention eliminates the problems described above by providing an adjustable uncoupling lever having a wedge lock. The lever is formed by two adjacent side by side rods. A wedge having a retaining nib is driven between the two rods to secure the rods against shifting relative to one another after adjustment. The wedge before being driven to secure the rods is retained between the rods to allow longitudinal adjustment of the rods.

Accordingly, it is an object of this invention to provide for a novel uncoupler rod.

Another object of this invention is to provide for an adjustable uncoupler rod.

Another object of this invention is to provide for an adjustable two piece uncoupler rod having a novel wedge lock to secure the two rods relative to one another.

Other objects of the invention will become apparent upon a reading of the following description taken with the accompanying drawings.

DESCRIPTION OF THE PREFERRED EMBODIMENT

The preferred embodiment herein depicted is not intended to be exhaustive or to limit the application to the precise forms disclosed. Rather it is chosen and described in order that others skilled in the art might utilize its teachings.

Figure 5:
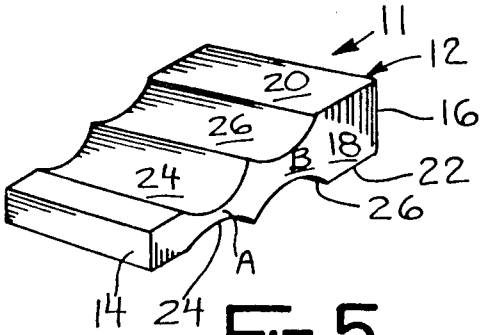
FIG. 5 is a perspective view of the wedge lock of this invention.

The uncoupler lever 10 of this invention includes wedge lock 11 having a generally rectangular body 12 defined by a fore end 14, a rear end 16, side edges 18, and sides 20 and 22 (See FIG. 5). Two arcuate notches 24 and 26 are formed in each of sides 20 and 22. Arcuate notches 24 are opposite one another as are notches 26. Notches 24 are separated by a thickness A of wedge lock 11 as illustrated in FIG. 5 and notches 26 are separated by a thickness B of the wedge lock. As can be seen by reference to the figures, thickness B of wedge lock 11 is greater than thickness A, and rear end 16 is thicker than fore end 14 to form a wedge shape.

Uncoupling lever 30 includes a rod 32 and a rod 34. Rod 32 has a hooked end 36 adapted for connection to a railroad car uncoupler lock lifter (not shown) as is common in the industry. The opposite end of rod 32 includes a sleeve 38 having a transverse dimension sufficient to slidably accommodate rod 34. Rod 34 includes a handle 42 at its distal end and a sleeve 44 at its opposite or proximal end. Sleeve 44 slidably accommodates rod 32. A more thorough understanding of the interconnection of rod 30 to the uncoupling mechanisms of a railroad car and the necessity for rod length adjustment may be had by a reading of U.S. Pat. No. 4,030,613 issued to Chierici on Jun. 21, 1977, incorporated herein by reference.

Figure 1:
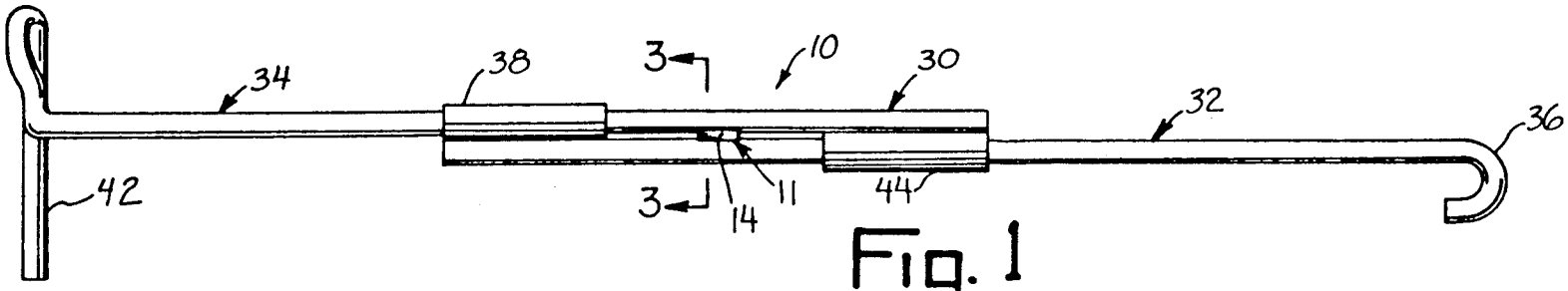
FIG. 1 is an elevational view of an uncoupling lever with the rods in their unlocked, adjustable position.

In use of the described invention, wedge lock 11 is carried at its notches 24 between rods 32, 34, preferably at a midpoint between sleeves 38, 44. Wedge lock 11 is shiftable between the unlocked position of FIGS. 1 and 3 and the locked position of FIGS. 2 and 4. In wedge lock's unlocked position, rod 32, 34 are generally aligned with arcuate notches 24 with the spacing between the rods at parts 40, 46 being slightly greater than width A but less than width B of wedge 10. Therefore, in the wedge's unlocked position of FIGS. 1 and 3, rods 32, 34 are slidable relative to one another to enable a user to adjust the overall length of uncoupling lever 30. Wedge lock 11 is retained between rods 32, 34 by the width of fore end 14 which is greater than the spacing between rods 32, 34.

Figure 2:
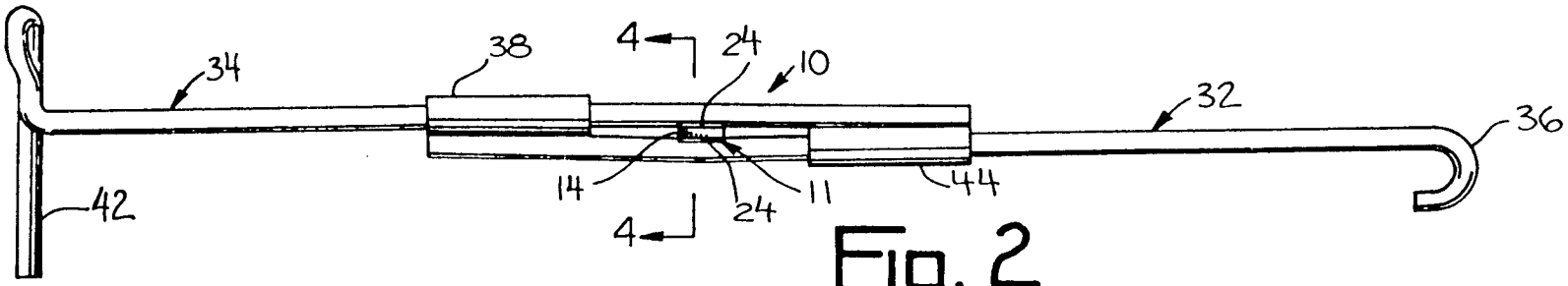
FIG. 2 is the elevational view with the rods in their locked position.
Figure 4:
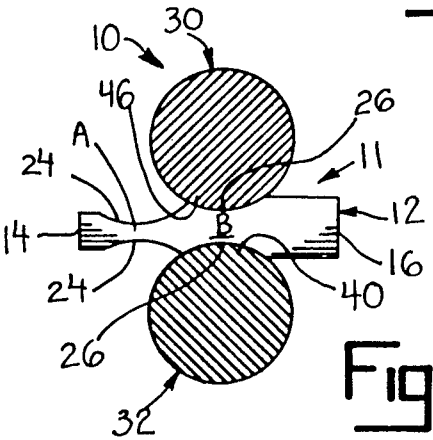
FIG. 4 is a cross sectional view taken from line 4-4 of FIG. 2.
Figure 3:
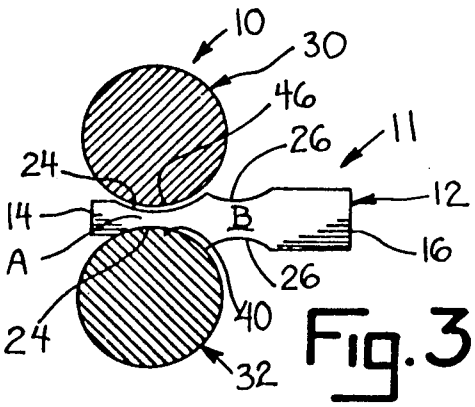
FIG. 3 is a cross sectional view taken from line 3-3 of FIG. 1.

After adjustment of the overall length of uncoupling lever 30, rods 32, 34 are locked in place, and thereby prevented from shifting relative to one another, by wedge lock 11 being abruptly driven between rods 32, 34 to seat the rods in notches 26. As illustrated in FIGS. 2 and 4 with wedge lock 11 in its locked position, rods 32, 34 are slightly bowed between sleeves 38, 40. To unlock the rods for adjustment of the overall length of uncoupler lever 30, wedge lock 11 is struck on fore end 14 to position rods 32, 34 in alignment with notches 24 which, as discussed previously, allows rods 32, 34 to be slid relative to one another. Therefore only a hammer or sledge is required to lock or unlock the uncoupling lever 30 for adjustment.

It should be understood that the invention is not to be limited to the precise forms disclosed but may be modified within the scope of the appended claims.

I claim:

1. An uncoupling lever for connection between an uncoupling device of a railroad car and an uncoupling lever bracket carried by said railroad car, said lever comprising first and second rods positioned in an offset generally parallel relationship, means connecting said rods for longitudinal movement relative to each other, said rods being spaced apart at adjacent locations, and means carried by said lever and extending fully between said rods at said adjacent locations for locking said rods against said longitudinal movement relative to each other.

2. The uncoupling lever of claim 1 wherein said locking means is shiftable between said adjacent locations of said rods in a transverse direction relative to said rods for locking said rods.

3. The uncoupling lever of claim 2 wherein said locking means includes a first part positionable between said adjacent locations of said rods in a forceful wedged relationship preventing relative longitudinal movement between the rods and a second part longitudinally spaced from said first part positionable between said adjacent locations permitting relative longitudinal movement between the rods.

4. An uncoupling lever for connection between an uncoupling device of a railroad car and an uncoupling lever bracket carried by said railroad car, said lever comprising first and second rods positioned in an offset generally parallel relationship, means connecting said rods for longitudinal movement relative to each other, said rods having adjacently located spaced parts, said means carried by said lever and extending between said spaced parts for locking said rods against said longitudinal movement relative to each other, said means including a body having first and second separate thicknesses, said first thickness being less than the spacing between said rod parts, said second thickness being greater than said spacing between rod parts, said means being shiftable between an unlocked position wherein said first body thickness is positioned between said rod parts and a locked position wherein said second body thickness is positioned between said rod parts.

5. The uncoupling lever of claim 4 wherein said first and second body thicknesses are defined by opposing pairs of arcuate surfaces.

* * * * *